US012458852B2

(12) United States Patent
Lee et al.

(10) Patent No.: US 12,458,852 B2
(45) Date of Patent: Nov. 4, 2025

(54) ADJUSTABLE HEIGHT GOLF CUP

(71) Applicant: The Toro Company, Bloomington, MN (US)

(72) Inventors: Hyok Lee, Bloomington, MN (US); Peter Nanninga, Bloomington, MN (US); Brian Qualls, Bloomington, MN (US)

(73) Assignee: The Toro Company, Bloomington, MN (US)

( * ) Notice: Subject to any disclaimer, the term of this patent is extended or adjusted under 35 U.S.C. 154(b) by 575 days.

(21) Appl. No.: 18/050,362

(22) Filed: Oct. 27, 2022

(65) Prior Publication Data

US 2023/0143848 A1 May 11, 2023

Related U.S. Application Data

(60) Provisional application No. 63/263,639, filed on Nov. 5, 2021.

(51) Int. Cl.
*A63B 57/40* (2015.01)

(52) U.S. Cl.
CPC ..... *A63B 57/40* (2015.10)

(58) Field of Classification Search
CPC ..... A63B 57/40
USPC ..... 473/175
See application file for complete search history.

(56) References Cited

U.S. PATENT DOCUMENTS

| | | | | | |
|---|---|---|---|---|---|
| 4,290,603 | A * | 9/1981 | Barnes | A63B 57/405 | 473/177 |
| 5,427,371 | A | 6/1995 | Huston et al. | | |
| 5,674,131 | A * | 10/1997 | Forbes | A63B 57/405 | 473/177 |
| 6,110,053 | A * | 8/2000 | Sjoblom | A63B 57/40 | 473/179 |
| 6,767,289 | B2 * | 7/2004 | Porter | A63B 57/357 | 473/175 |
| 2002/0094878 | A1 * | 7/2002 | Porter | A63B 57/357 | 473/175 |
| 2004/0235580 | A1 | 11/2004 | Barlow et al. | | |
| 2024/0009531 | A1 * | 1/2024 | Cornell | A63B 57/405 | |

* cited by examiner

*Primary Examiner* — Michael G Lee
(74) *Attorney, Agent, or Firm* — Inskeep IP Group, Inc.

(57) ABSTRACT

A golf cup device that can be easily removed and replaced at a desired height or elevation relative to surrounding turf includes an outer sleeve and an inner cup assembly that slides into the outer sleeve. A height adjustment mechanism connects the inner cup assembly to the outer sleeve, allowing a user to mount the inner cup assembly at various heights/elevations relative to the outer sleeve. This allows the outer sleeve to be initially buried within the ground and then the inner cup assembly to be positioned within the installed outer sleeve.

20 Claims, 11 Drawing Sheets

ADJUSTABLE HEIGHT GOLF CUP

RELATED APPLICATIONS

This application claims benefit of and priority to U.S. Provisional Application Ser. No. 63/263,639 filed Nov. 5, 2021 entitled Adjustable Height Golf Cup, which is hereby incorporated herein by reference in its entirety.

BACKGROUND OF THE INVENTION

Golf cups are a well-known component of the game of golf that typically comprise a cylindrical cup that is placed in the ground so that golf balls can fall or be hit in. Traditionally, golf cups have been relatively simple plastic cup shapes that are buried so that their upper edge is even with the surrounding turf. Once installed, traditional golf cups rarely need to be removed and replaced.

More recently, illuminated golf cups have become popular, as seen in U.S. Pat. No. 7,594,859, the contents of which is hereby incorporated by reference. These golf cups include a lower light assembly that connects to a wired or battery power supply and includes one or more lights that shine upward from the cup, illuminating both the cup and the cup flag that might be present in the cup.

These illuminated golf cups tend to require removal for servicing more frequently than their traditional cup counterparts. For example, light bulbs may need replacement, wiring may need replacement, batteries (if used) may need replacement, or the light assembly may be removed for winter months.

In these circumstances, the entire cup must be removed and then replaced by first removing soil and turf from around the cup and then replacing that soil and turf later. Typically, the top edge of the cup must be placed at the exact height of the surrounding turf and then soil and turf are backfilled around the cup. Even when great care is taken, it can be difficult to achieve the exact same height of the cup's top edge with the replaced soil. Additionally, not all turf surrounding the cup may be the exact same height. Again, if the cup's top edge is not close or identical to the surrounding turf, a golf ball may not roll into the cup as expected and thereby interfere with a golf player's game.

Hence, what is needed is a golf cup that can be removed and replaced in an easier manner. Additionally, such a golf cup will allow for precise height adjustment relative to the surrounding turf so that such a desirable cup position can be easily achieved.

SUMMARY OF THE INVENTION

The present specification is directed to embodiments of a golf cup device that can be easily removed and replaced at a desired height or elevation relative to surrounding turf. Generally, the embodiments described herein include an outer sleeve and an inner cup assembly that slides into the outer sleeve. A height adjustment mechanism connects the inner cup assembly to the outer sleeve, allowing a user to mount the inner cup assembly at various heights/elevations relative to the outer sleeve. This allows the outer sleeve to be initially buried within the ground and then the inner cup assembly to be positioned within the installed outer sleeve. As long as a top edge or surface of the outer sleeve is positioned below the surrounding turf, the height of the inner cup assembly can be adjusted to the desired level height via the height adjustment mechanism.

In one example, the height adjustment mechanism may comprise a plurality of stepped areas that engage with one or more fins or ribs.

In another example, the height adjustment mechanism may comprise one or more set screws that adjustably extend from a side of the inner cup assembly. In another example, the height adjustment mechanism may comprise a washer or resilient ring positioned on an outer surface of the inner cup assembly and which engages a ledge or angled surface of the outer sleeve.

In another example, the height adjustment mechanism may comprise helical threads located on the inner surface of the outer sleeve and the outer sidewall surface of the inner cup assembly.

In another example, the height adjustment mechanism may comprise one or more pins that extend radially outward from the inner cup assembly to engage one or more vertical and horizontal channels in the inner surface of the outer sleeve.

In another example, the height adjustment mechanism may comprise a kit with a plurality of platforms of different sizes which can be placed, one at a time, under the inner cup assembly.

In another example, the height adjustment mechanism may comprise a clamp that clamps the outer sleeve against the inner cup assembly.

In another example, the height adjustment mechanism may comprise a plurality of ridges and grooves between the inner surface of the outer sleeve and the outer surface of the inner cup assembly.

In another example, the height adjustment mechanism may comprise a pull pin positioned through a wall of the inner cup assembly to engage the outer sleeve.

In another example, the height adjustment mechanism may comprise a screw that passes through a floor of the inner cup assembly and is located near a bottom of the outer sleeve.

In another example, the height adjustment mechanism may comprise a detent mechanism. In another example, the height adjustment mechanism may comprise a plurality of magnets within the walls of the outer sleeve and the inner cup assembly.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DETAILED DESCRIPTION

Figure 1:
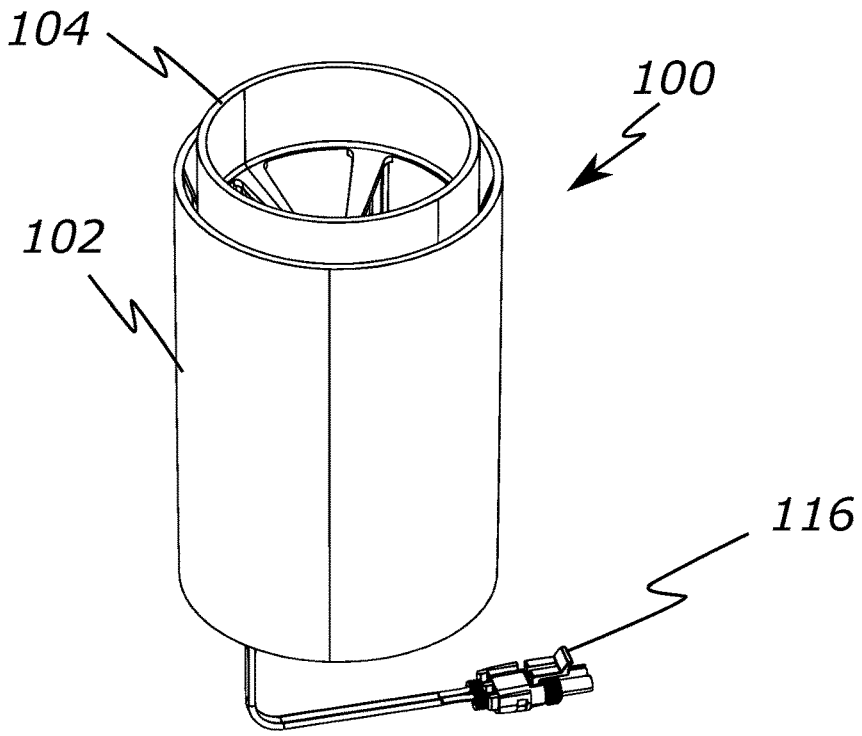
FIG. 1 illustrates a side view of a golf cup device with a height adjustment mechanism.
Figure 2:
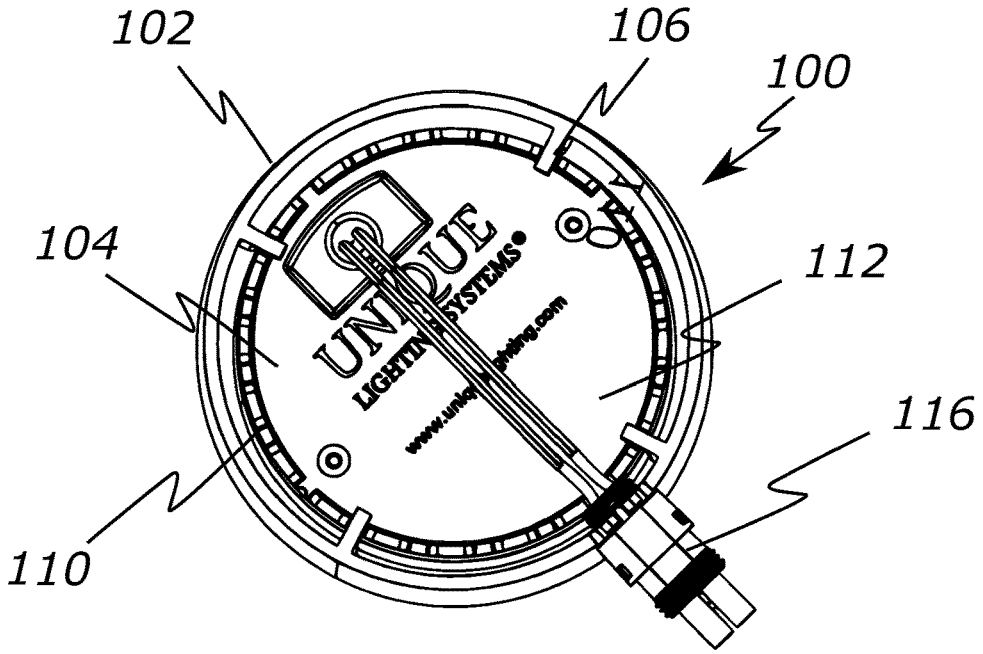
FIG. 2 illustrates a bottom view of a golf cup device with a height adjustment mechanism.
Figure 3:
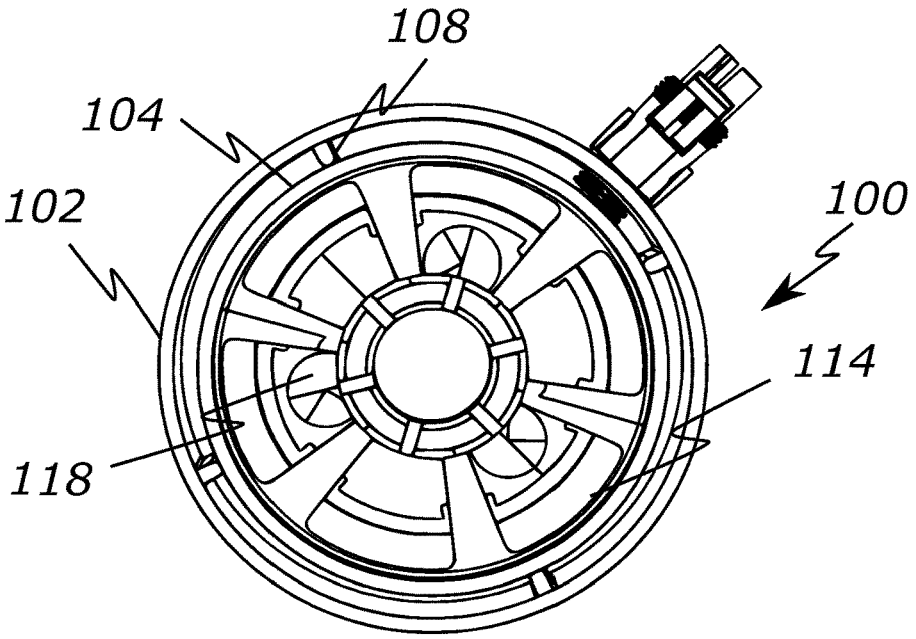
FIG. 3 illustrates a top view of a golf cup device with a height adjustment mechanism.
Figure 4:
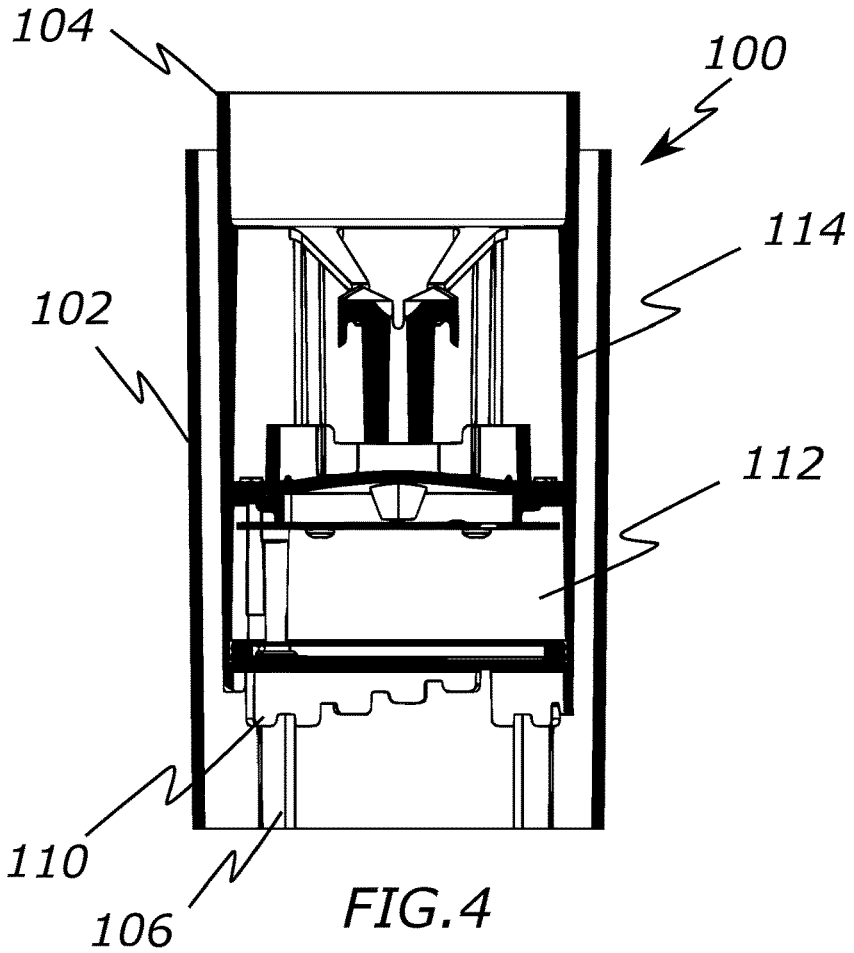
FIG. 4 illustrates a side cross sectional view of a golf cup device with a height adjustment mechanism.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

While different embodiments may be described in this specification, it is specifically contemplated that any of the features from different embodiments can be combined in any combination. In other words, the features of different embodiments can be mixed and matched with each other. Hence, while every permutation of features from different embodiments may not be explicitly shown, it is the intention of this specification to cover any such combinations.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

The present specification is directed to embodiments of a golf cup device that can be easily removed and replaced at a desired height or elevation relative to surrounding turf. Generally, the embodiments described herein include an outer sleeve and an inner cup assembly that slides into the outer sleeve. A height adjustment mechanism connects the inner cup assembly to the outer sleeve, allowing a user to mount the inner cup assembly at various heights/elevations relative to the outer sleeve. This allows the outer sleeve to be initially buried within the ground and then the inner cup assembly to be positioned within the installed outer sleeve. As long as a top edge or surface of the outer sleeve is positioned below the surrounding turf, the height of the inner cup assembly can be adjusted to the desired level height via the height adjustment mechanism.

Many of the examples of a height adjustment mechanism are located on an outer wall surface of an inner cup assembly, an inner wall surface of an outer sleeve, or both.

In one example, the height adjustment mechanism may comprise a plurality of stepped areas or regions that engage with one or more fins or ribs. In another example, the height adjustment mechanism may comprise one or more set screws that adjustably extend from a side of the inner cup assembly. In another example, the height adjustment mechanism may comprise a washer or resilient ring positioned on an outer surface of the inner cup assembly and which engages a ledge or angled surface of the outer sleeve. In another example, the height adjustment mechanism may comprise helical threads located on the inner surface of the outer sleeve and the outer sidewall surface of the inner cup assembly. In another example, the height adjustment mechanism may comprise one or more pins that extend radially outward from the inner cup assembly to engage one or more vertical and horizontal channels in the inner surface of the outer sleeve. In another example, the height adjustment mechanism may comprise a kit with a plurality of platforms of different sizes which can be placed, one at a time, under the inner cup assembly. In another example, the height adjustment mechanism may comprise a clamp that clamps the outer sleeve against the inner cup assembly. In another example, the height adjustment mechanism may comprise a plurality of ridges and grooves between the inner surface of the outer sleeve and the outer surface of the inner cup assembly. In another example, the height adjustment mechanism may comprise a pull pin positioned through a wall of the inner cup assembly to engage the outer sleeve. In another example, the height adjustment mechanism may comprise a screw that passes through a floor of the inner cup assembly and is located near a bottom of the outer sleeve. In another example, the height adjustment mechanism may comprise a detent mechanism. In another example, the height adjustment mechanism may comprise a plurality of magnets within the walls of the outer sleeve and the inner cup assembly.

Some examples of this specification are depicted with a light assembly for illuminating the interior of the golf cup device and other examples do not depict the light assembly. However, any of the embodiments of this specification may include this light assembly. Alternately, any of the embodiments may also or alternatively include other components that may require periodic removal and maintenance, such as sensor assemblies, wireless transceivers (e.g., repeaters for mesh networks), location beacons, RFID transceivers, or other electronic devices. Alternatively, any of the embodiments may not include any electronic devices.

FIGS. 1-9 illustrate various views of one embodiment of a golf cup device 100 with a height adjustment mechanism that allows height or elevation adjustment between an outer sleeve 102 and an inner cup assembly 104. As previously discussed, this height adjustment mechanism allows the outer sleeve 102 to be installed within the soil with less precision since the inner cup assembly 104 can be adjusted (and removed) relative to the outer sleeve 102 and surrounding turf.

Figure 5:
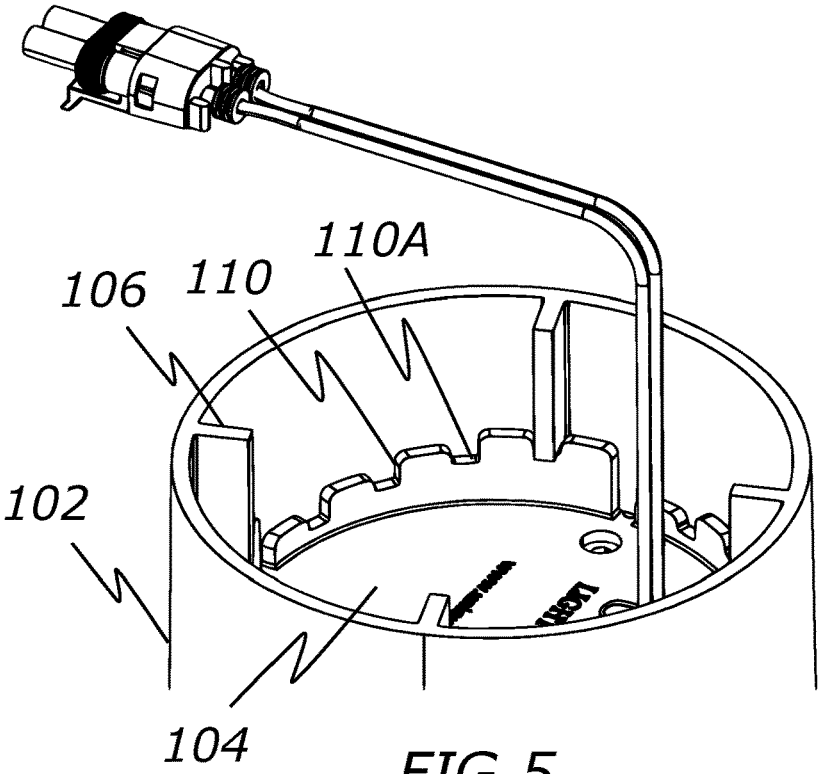
FIG. 5 illustrates a bottom view of an inner cup assembly with a height adjustment mechanism.
Figure 6:
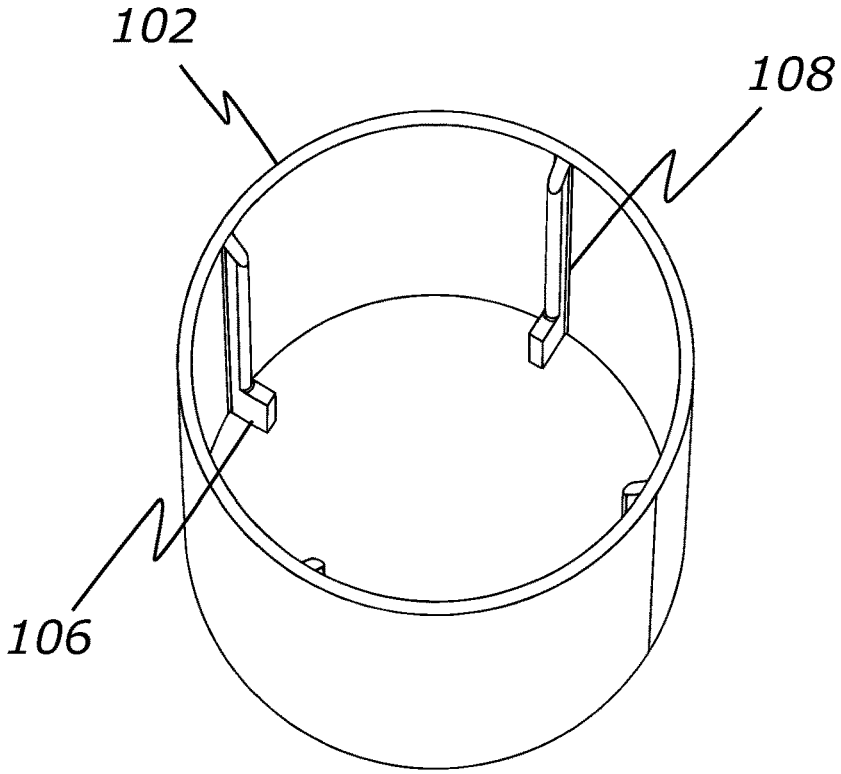
FIG. 6 illustrates a top view of an outer sleeve with a height adjustment mechanism.
Figure 7:
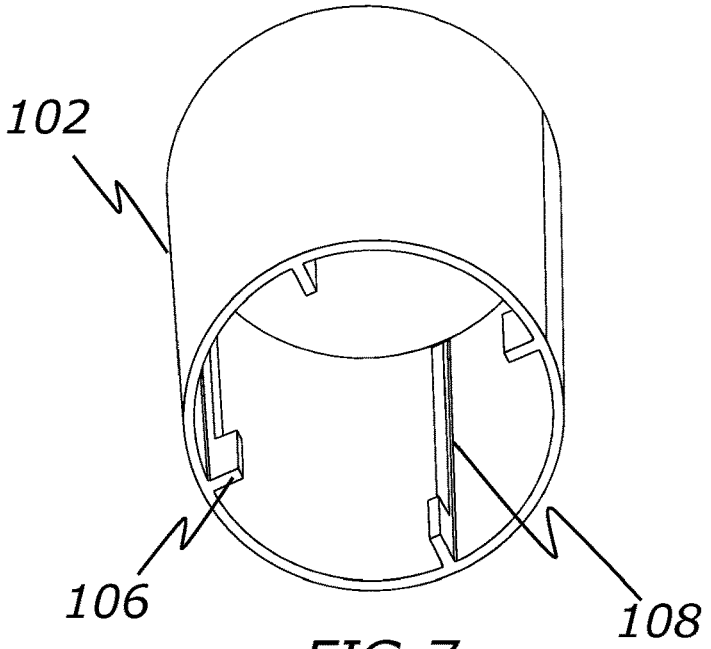
FIG. 7 illustrates a bottom view of an outer sleeve with a height adjustment mechanism.

The height adjustment mechanism may include a plurality of stepped areas at different heights or elevations that engage with one or more fins or ribs. For example, FIG. 5 illustrates a bottom end of the golf cup device 100 in which the outer sleeve 102 includes a plurality of ribs 106 extending radially inwards and a bottom of the inner cup assembly 104 has a plurality of stepped regions 110, each of which having steps at different heights. Depending on the rotational orientation of the inner cup assembly 104, only stepped areas 110 of a particular height rest on the one or more ribs 106. Hence, partially removing, rotating, and reseating the inner cup assembly 104 results in changing the height of the inner cup assembly 104 relative to the outer sleeve 102.

The golf cup assembly 100 may include the same number of stepped regions 110 as ribs 106. The stepped regions 110 may also be positioned equal distances from each other and the ribs 106 may also be positioned at equal distances from each other such that the ribs 106 may contact the step of each stepped region 110 having the same elevation at the same time or rotational position of the inner cup assembly 104.

The ribs 106 may be located near a bottom of the outer sleeve 102 or at relatively higher locations, such as 0.5 inch, 1 inch, 2 inches, or more from the bottom of the outer sleeve 102.

In an alternate example, the ribs 106 may instead be located on a side of the inner cup assembly 104 and the stepped areas 110 can be located on an inside of the sleeve 102.

The outer sleeve 102 may have a cylinder shape with a round cross section shape. The outer sleeve 102 may have a bottom floor or surface, or may be free of a floor or bottom surface so as to expose soil underneath when installed.

In addition to its ribs 106, smaller ribs 108 may also be included on an inner surface of the sleeve 102. These smaller ribs 108 may be aligned with the ribs 106 or positioned at other radial positions/angles, and may extend most or all of the length between the top and bottom of the sleeve 102. These smaller ribs 108 help provide some spacing between the inner surface of the outer sleeve 102 and the outer side surface of the inner cup assembly 104. Without this spacing, if even small amounts of dirt are positioned between the two surfaces, they may grind, scratch, or even prevent the inner cup assembly from sliding into the outer sleeve 102.

The outer sleeve 102 can have almost any number of ribs 106 (e.g., 1, 2, 3, 4, 5, 6, 7, 8, 9, or 10), so long as both they are each sized and positioned to only engage one "step" of the stepped areas 110 at a time and that each of the steps engaged by the ribs 106 are of the same elevation relative to each other. Or put another way, the size and position of the stepped areas 110 is such that only steps at a single height simultaneously and evenly contact the ribs 106.

While the stepped areas 110 are shown extending from a bottom surface of the inner cup assembly 104, it is also possible that they are formed around the outer side surface of the inner cup assembly 104. For example, an outer sleeve with the steps cut into it may be fixed around the inner cup assembly 104.

Figure 9:
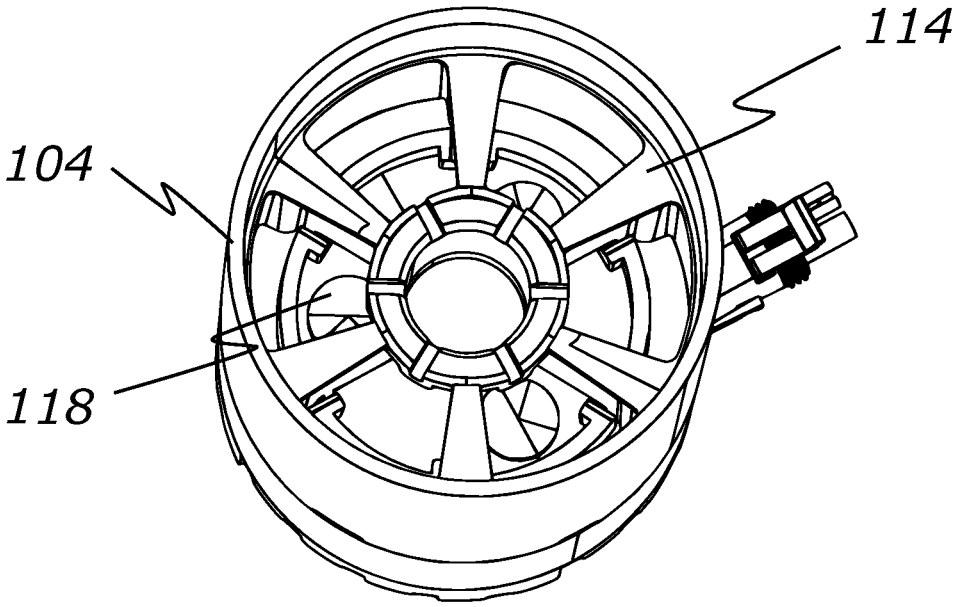
FIG. 9 illustrates a top view of an inner cup assembly with a height adjustment mechanism.

The inner cup assembly 104 may include an upper cup portion 114 fixed on an optional lower light assembly 112 (though the lower light assembly 112 may additionally or alternately include other electronic components, as noted earlier). The upper cup portion 114 has a generally cylindrical shape with an open top end. The interior of the cup portion 114 can include bottom angled ribs that forms a floor for a golf ball and a center aperture for holding a flag pole, as seen in FIG. 9, and as are generally found in traditional golf cups.

The lower light assembly 112 includes one or more (e.g., 3) lights 118 on its top surface that are arranged to shine through the bottom of the interior of the cup portion 114 (e.g., between the ribs) and out the top opening of the cup portion 114. The lights may be electrically connected to a power cable 116 that passes through a bottom surface of the lower light assembly 112.

Figure 8:
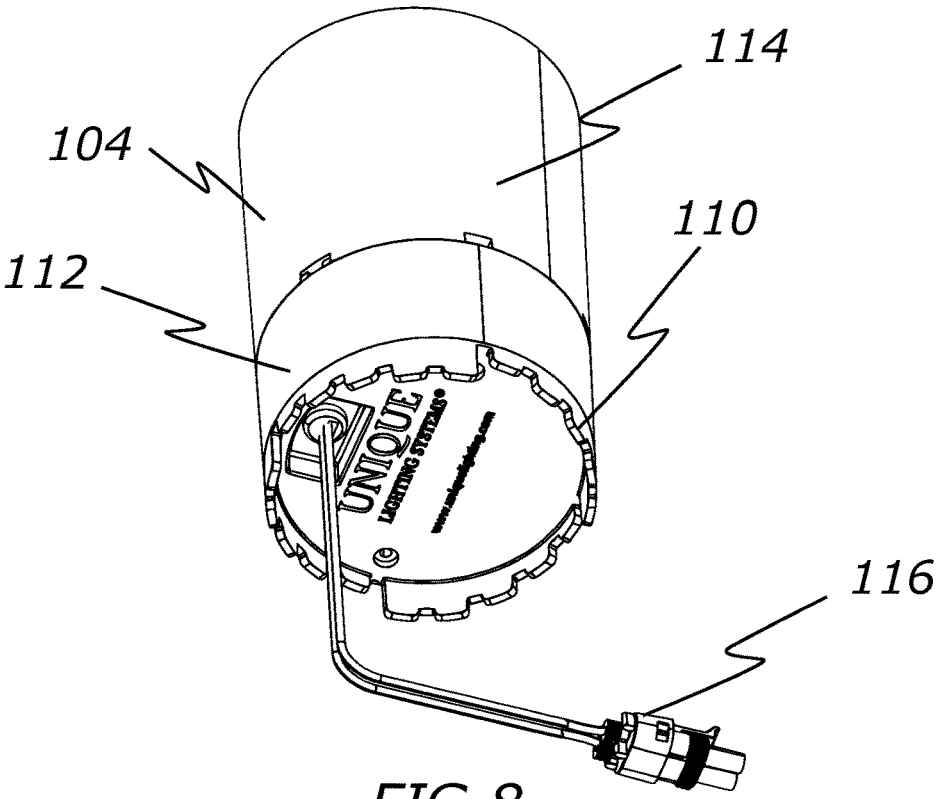
FIG. 8 illustrates a bottom view of an inner cup assembly with a height adjustment mechanism.

As best seen in FIG. 8, the stepped areas 110 can be formed from an outer ridge along the outer circumference of the light assembly 112 that extends downward or perpendicular to the bottom surface of the light assembly 112. In that respect, the steps of the stepped areas 110 may have a similar curvature as the outer wall of the light assembly 112 and/or cup portion 114 (i.e., the inner cup assembly 104). The stepped areas 110 include a plurality of steps that are spaced at different lengths away from the bottom surface of the light assembly 112. The number of steps of each specific height may correspond to the number of ribs 106 in the outer sleeve 102. For example, the outer sleeve 102 may have four ribs 106 that are each positioned 90 degrees from adjacent ribs 106. Similarly, steps of a certain height may be positioned at 90 degrees from each other so that that all steps of the same height can contact all of the ribs 106 simultaneously.

The stepped areas can have any number of steps that vary from each other in any increments. For example, the stepped areas 110 may have 2, 3, 4, 5, 6, 7, 8, 9, or 10 different step heights. Those step heights (or lengths from the bottom surface of the light assembly 112 or inner cup assembly 104) may be in increments of 0.1 inch, 0.25 inch, 0.5 inch, 0.75 inch, 1 inch or combinations of the same.

Each step may also include a shape that helps engage the rib 106. For example, each step may include a groove or indentation 110A that has a width sized to engage the rib 106. This generally prevents rotation of the inner cup assembly 104 relative to the outer sleeve 102 without vertical movement between the two first. An alternate approach to this description is that each step has raised portions on each side to create a groove and prevent rotation.

In practice, a user will first install the outer sleeve 102 in a hole in the ground and fill in the soil and turf surrounding its outer walls. A top surface of the outer sleeve 102 is preferably located level with or lower than the level of the surrounding turf.

Next, the inner cup assembly 104 is at least partially placed into the outer sleeve 102 so that its stepped areas 110 are pointing downward. The user allows the inner cup assembly 104 to move completely downward so that steps of the stepped areas 110 of a certain height all engage the ribs 106 of the inner sleeve 102.

The user determines if the height of the top surface of the inner cup assembly 104 is level with the surrounding turf. If not level, the inner cup assembly 104 is partially withdrawn from the outer sleeve 102, rotated slightly, and placed back down, thereby allowing steps of a different height to all engage the ribs 106 of the inner sleeve 102. This process is repeated until the desired height of the inner cup assembly 106 (i.e., its top being level with the surrounding turf) is achieved.

The remaining embodiments of this specification discuss alternate height adjustment mechanisms between an outer sleeve 102 and an inner cup assembly 104. While features of both items are depicted in a simplified form (e.g., without the light assembly 112), they can include any of the features and description of that of FIGS. 1-9, including the light assembly.

Figure 10:
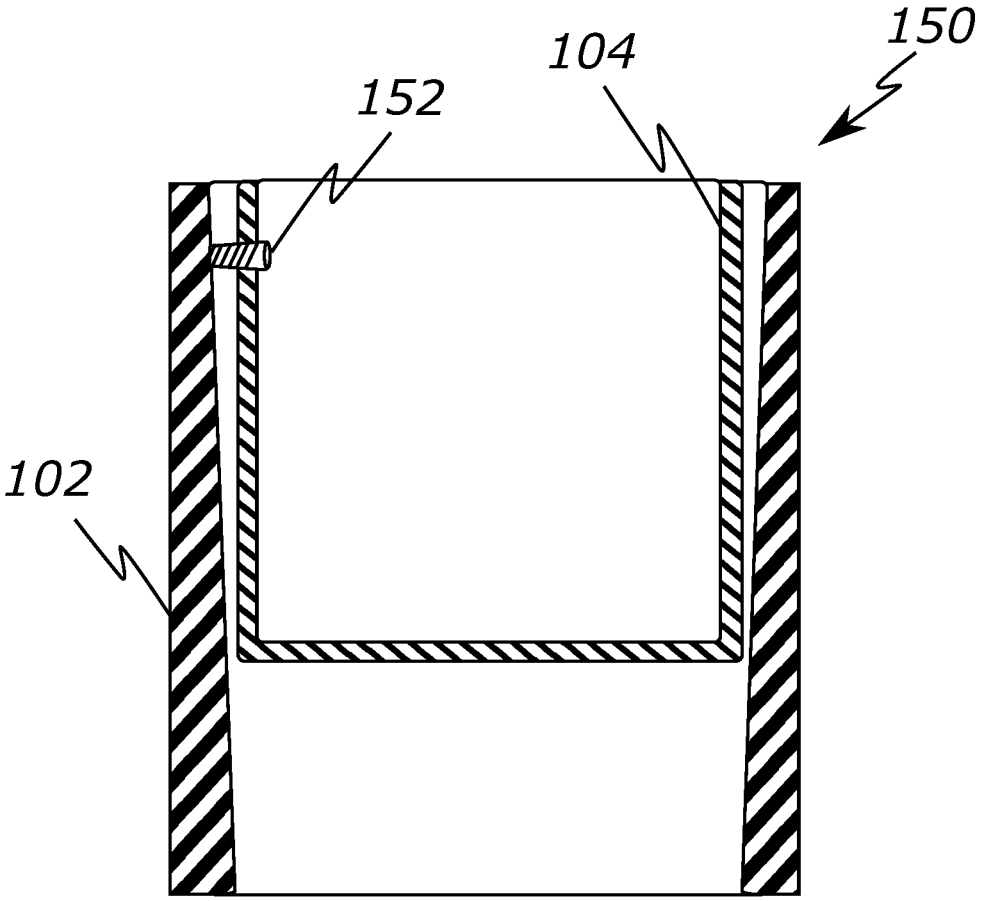
FIG. 10 illustrates another embodiment of a golf cup device with a height adjustment mechanism.

FIG. 10 illustrates another embodiment of a golf cup device 150 with a height adjustment mechanism. Specifically, the height adjustment mechanism may include one or more set screws 152 that pass through one or more apertures in a sidewall the inner cup assembly 104 to engage the inner wall of the outer sleeve 102. In this manner, the inner cup assembly 104 can be moved to a desired position and the set screws 152 can be screwed to radially extend into the outer sleeve 102, locking the two components in place. Optionally, the inner walls of the outer sleeve 102 may radially increase in size downward (i.e., toward the dirt and away from the sky), thereby decreasing the diameter of its passage downward. This may allow the set screws to be set to a specific position outside of the sleeve 102 and therefore engage the sleeve walls at a specific position as the inner cup assembly 104 is positioned into the sleeve 102. The inner cup assembly 104 may have 1, 2, 3, 4, or more set screws that may be placed at equal distances from each other.

Figure 11:
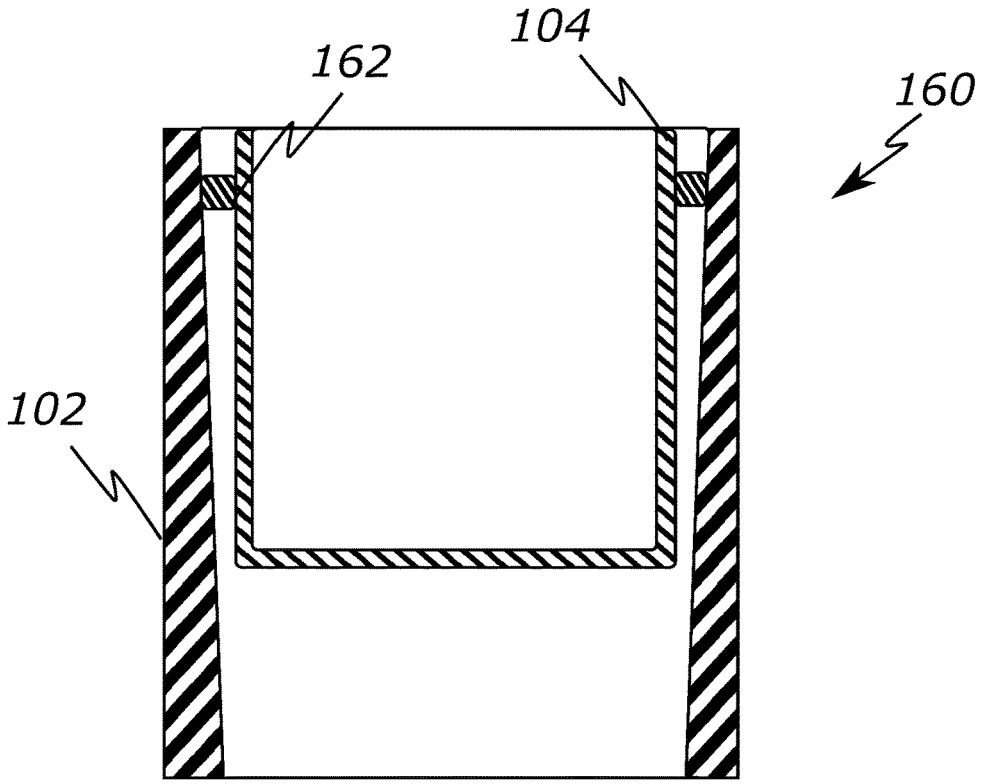
FIG. 11 illustrates another embodiment of a golf cup device with a height adjustment mechanism.

FIG. 11 illustrates another embodiment of a golf cup device 160 with a height adjustment mechanism. Specifically, the inner cup assembly 104 may include a washer or resilient ring 162 positioned on its outside surface. The ring 162 may contact a fixed ledge on the inner surface of the outer sleeve 102 or may wedge against the inner surface of the outer sleeve 102 if that passage downwardly tapers (as shown in FIG. 11). The ring 162 may frictionally engage the inner cup assembly 104 but may also be movable to different locations/heights on the inner cup assembly 104. Hence, by adjusting the height of the ring 162, the ultimate height of the inner cup assembly 104 within the outer sleeve 102 can also be adjusted.

Figure 12:
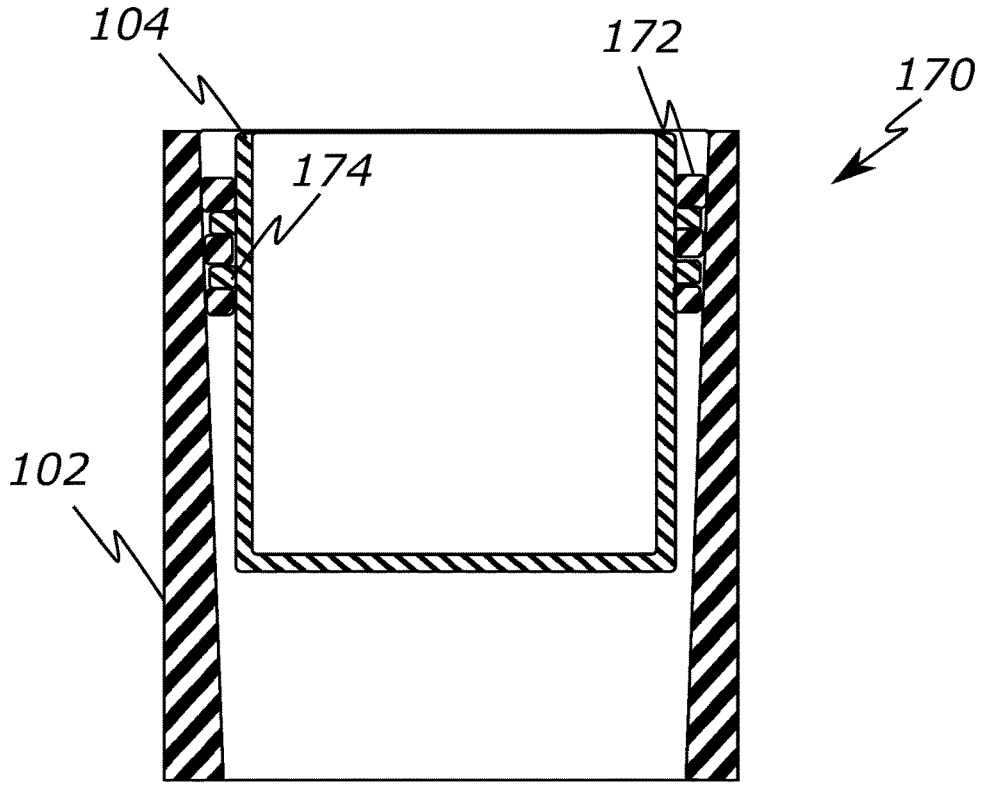
FIG. 12 illustrates another embodiment of a golf cup device with a height adjustment mechanism.

FIG. 12 illustrates another embodiment of a golf cup device 170 with a height adjustment mechanism. Specifically, the outer surface of the inner cup assembly 104 may include a helical thread 174 that is configured to engage a mating helical thread 172 on the inner surface of the outer sleeve 102. Hence, the inner cup assembly 104 can be rotated within the outer sleeve 102 to adjust its relative height.

Figure 13:
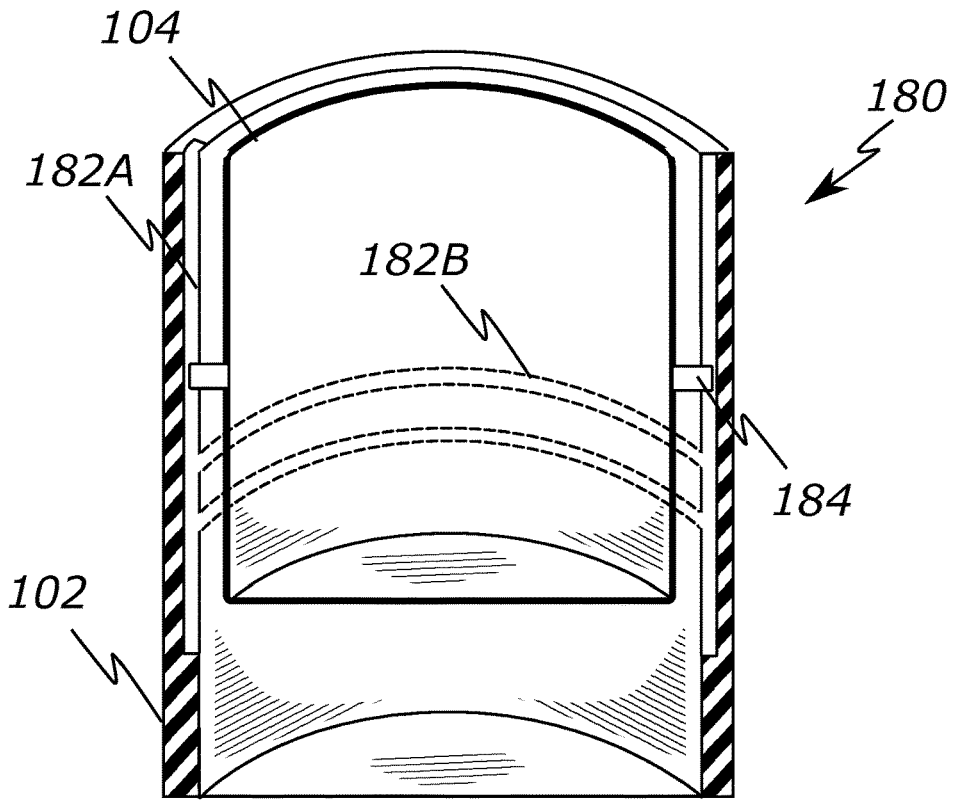
FIG. 13 illustrates another embodiment of a golf cup device with a height adjustment mechanism.

FIG. 13 illustrates another embodiment of a golf cup device 180 with a height adjustment mechanism. Specifically, the outer surface of the inner cup assembly 104 includes one or more pins 184 that extend radially outward to engage or fit into one or more channels 182 in the inner surface of the outer sleeve 102. The channels 182 or grooves have a vertical channel 182A that extends downward and connects to two or more horizontal or circumferential channel 182B. As the inner cup assembly 104 is moved downwards, one pin 184 is aligned with and enters the vertical channel 182A. Once the pin 184 reaches an elevation of one of the horizontal circumferential channels 182B, the inner cup assembly 104 can be rotated, causing the pin 184 to move into the circumferential channels 182B and then preventing the inner cup assembly 104 from moving vertically. Hence, the inner cup assembly 104 can be rotated to a certain predetermined position that allows vertical movement and then can allow further rotation to lock the vertical position of the inner cup assembly 104.

The number of pins 184 preferably corresponds to the number of vertical channels 182A. For example, 1, 2, 3, 4, 5, or 6 pins/channels can be used. 2, 3, 4, 5, 6, 7, 8, or more circumferential channels may be included and may be positioned at vertical intervals from each other such as 0.1 inch, 0.25 inch, 0.5 inch, 0.75 inch, or 1 inch.

Figure 14:
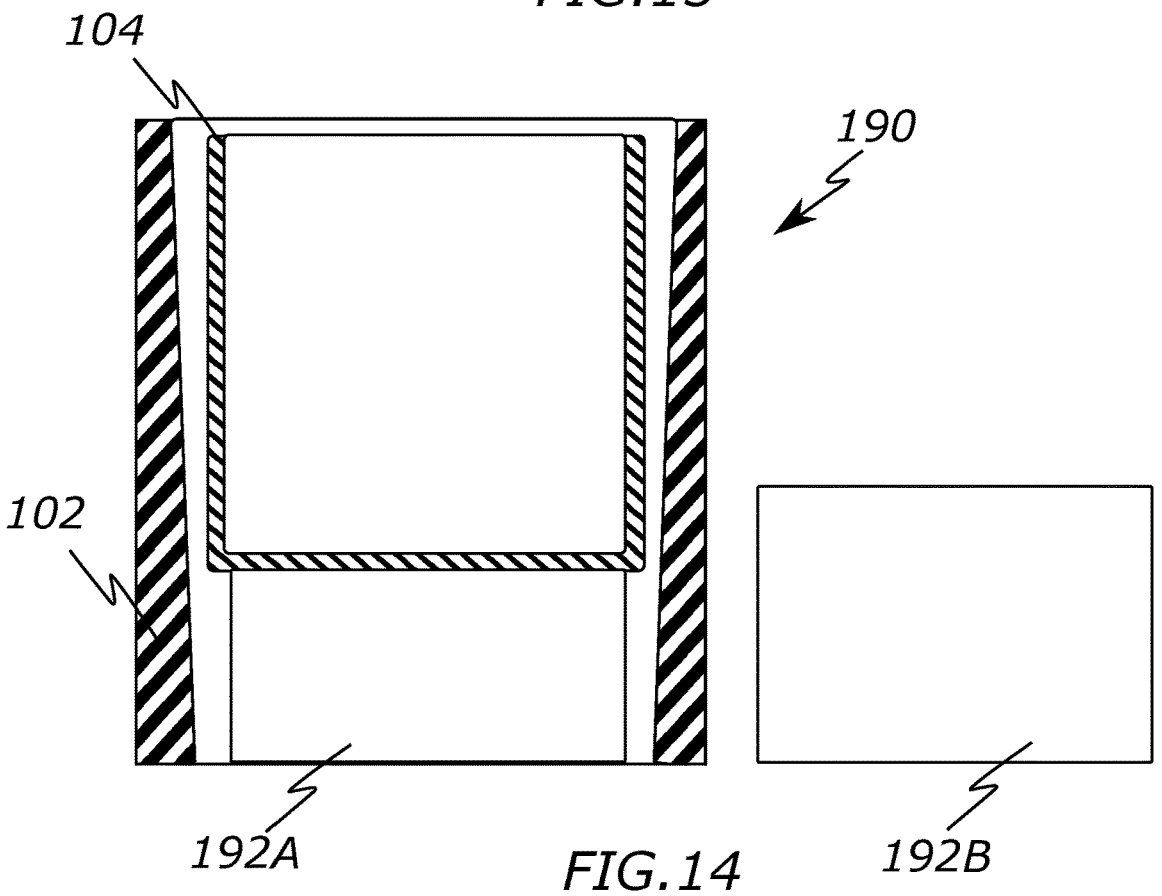
FIG. 14 illustrates another embodiment of a golf cup device with a height adjustment mechanism.

FIG. 14 illustrates another embodiment of a golf cup device 190 with a height adjustment mechanism. Specifically, the height adjustment mechanism comprises a kit with a plurality of different platforms 192 that each have different sizes. A single platform, such as platform 192A is placed underneath the inner cup assembly 104 and against the floor of the outer sleeve 102 to maintain the inner cup assembly 104 at a desired height. However, if platform 192A does not allow the inner cup assembly 104 to achieve a desired height, a different platform, such as taller platform 192B, can replace the prior platform 192A.

Alternately, instead of using only a single platform 192, a plurality of smaller height platforms can be stacked in a number to achieve a desired height of the inner cup assembly 104. These plurality of platforms can be, for example, all the same height or different heights, including 0.1 inch, 0.25 inch, 0.5 inch, 0.75 inch, or 1 inch.

The platforms can be any structure, solid or hollow that fits within the outer sleeve 102 and has a radius sufficient to support the inner cup assembly 104 (i.e., similar in diameter). The platform(s) may have structural features that allow them to mate with each other, the inner cup assembly 104 and optionally the floor of the outer sleeve 102. Such features may include ridges and grooves, or even hook-and-loop, Velcro-style connectors.

Figure 15:
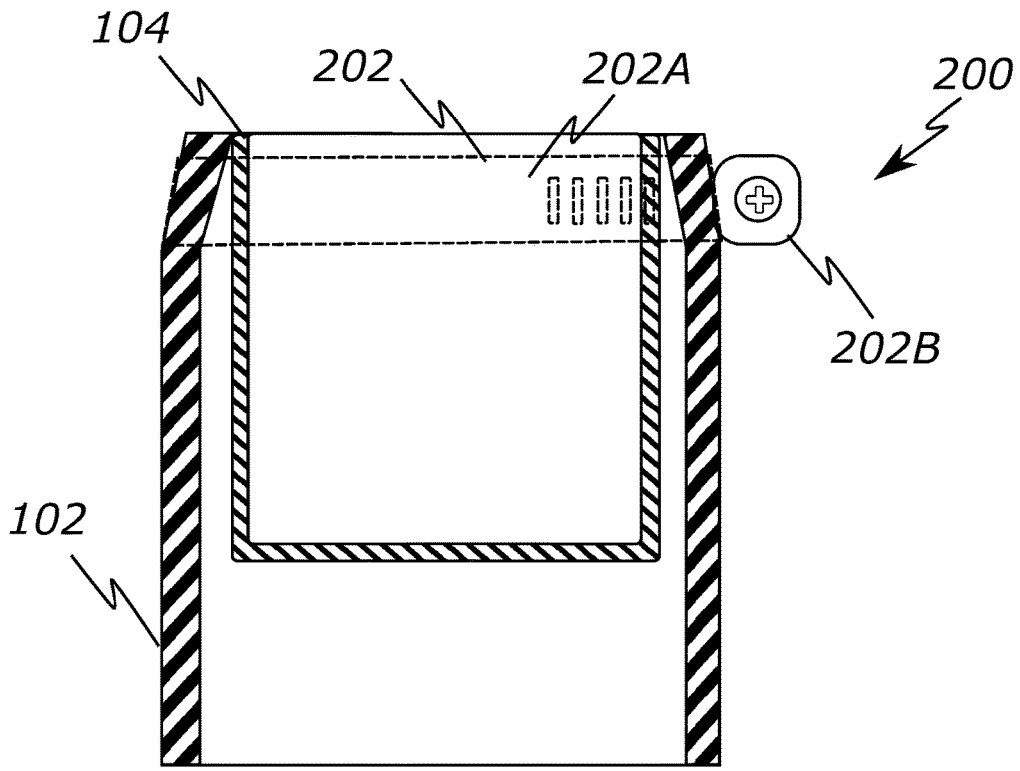
FIG. 15 illustrates another embodiment of a golf cup device with a height adjustment mechanism.

FIG. 15 illustrates another embodiment of a golf cup device 200 with a height adjustment mechanism. Specifically, the height adjustment mechanism comprises a clamp mechanism that clamps the outer sleeve 102 against the inner cup assembly 104. In one example, the clamp mechanism can be a hose clamp mechanism 202 that includes a band 202A that is tightened by a screw tightening mechanism 202B. Alternately, a spring clamp style hose clamp or similar mechanism can be used. All or a portion of the outer sleeve 102 may be composed of a material that flexes, at least somewhat, so that when the clamp mechanism is tightened, it tightens around the inner cup assembly 204.

Figure 16:
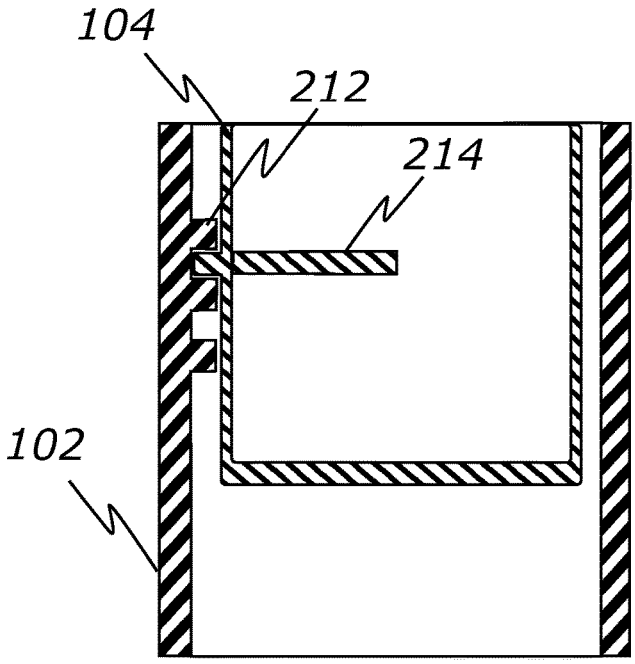
FIG. 16 illustrates another embodiment of a golf cup device with a height adjustment mechanism.
Figure 17:
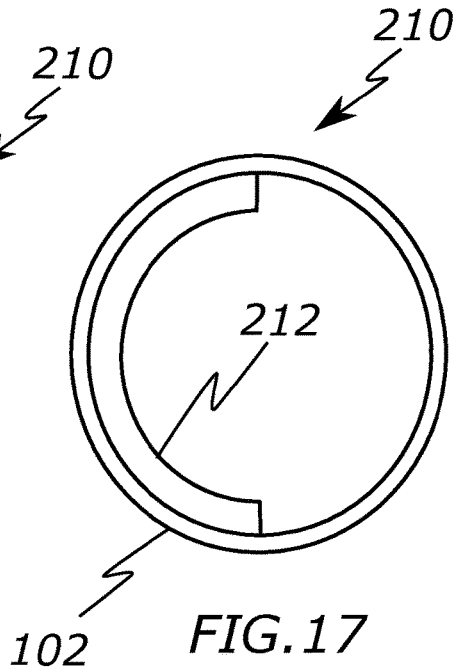
FIG. 17 illustrates a top view of the sleeve illustrating the ridges forming grooves between themselves.

FIGS. 16 and 17 illustrate another embodiment of a golf cup device 210 with a height adjustment mechanism. Specifically, the height adjustment mechanism comprises a plurality of ridges and grooves on the inner surface of the outer sleeve 102 and the outer surface of the inner cup assembly 104 that engage each other in one rotational position and disengage each other at a different rotational position of the inner cup assembly 104.

For example, the inner surface of the outer sleeve 102 may include a plurality of arc-shaped grooves embedded in its wall or a plurality of ridges 212 that form grooves between themselves. FIG. 17 illustrates a top view of the sleeve 102 illustrating the ridges 212 forming grooves between themselves. Similarly, the outer surface of the inner cup assembly 104 includes one or more arc shaped ridges 214 that are sized to mate with the grooves created by ridges 212. In the present example, both ridges 212 and 214 extend about 180 degrees, which allows the ridge 214 to disengage from the ridges 212 only when it is rotated completely opposite from the ridges 212. Hence, at least one rotational position of the inner cup assembly 104 can be disengaged with the sleeve 102 and at least one rotational position of the inner cup assembly 104 can be engaged with the sleeve 102.

A plurality of the ridges 212 can be spaced along the vertical length of the sleeve 102, such that a plurality of grooves at different heights are created. In that respect, a user can position the inner cup assembly 104 at a desired height and then rotate it to engage it in place. While 180 degree ridges are shown, other arc lengths are possible, such as 30 or 60 degrees. Additionally, the ridge's arc length 212 may be different from that of the ridge 214. For example, the ridge 214 may be relative smaller compared to that of ridges 212.

Figure 18:
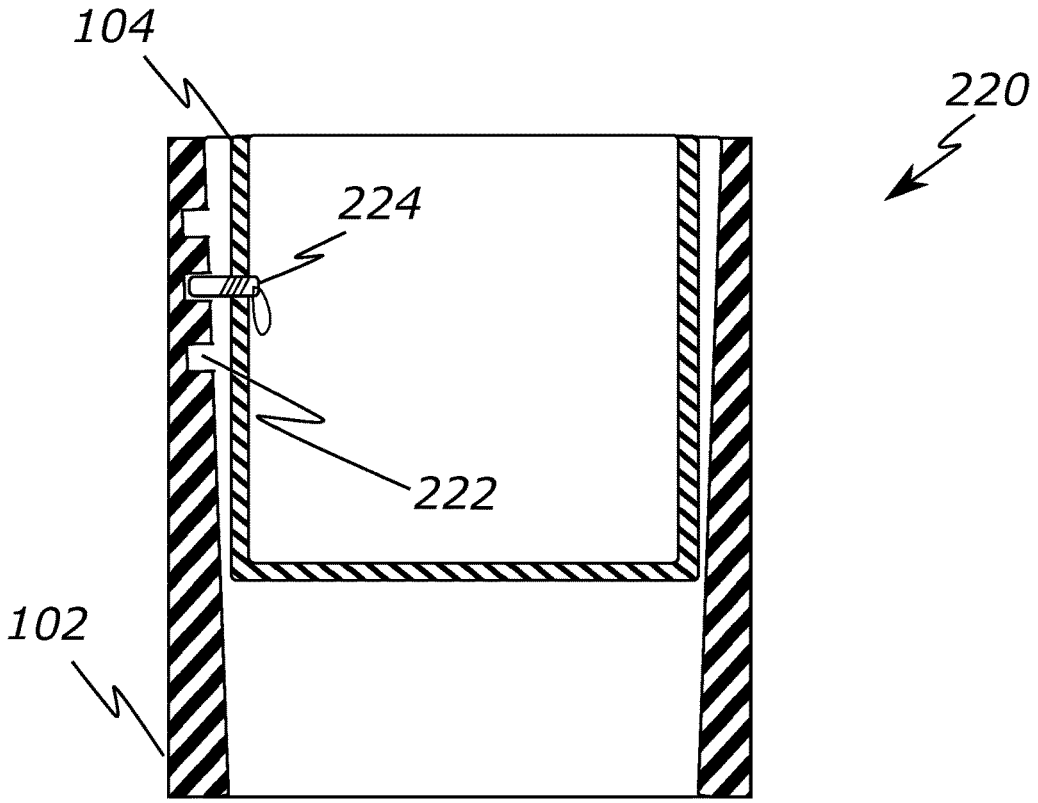
FIG. 18 illustrates another embodiment of a golf cup device with a height adjustment mechanism.

FIG. 18 illustrates another embodiment of a golf cup device 220 with a height adjustment mechanism. Specifically, the height adjustment mechanism comprises a spring-loaded pull-pin 224 that is positioned through a wall aperture of the inner cup assembly 104 and biased radially outward. The inner surface of the outer sleeve 102 includes a plurality of openings or depressions 222 at various heights sized to accept the pin 224. The pin 224 may include a wire loop or similar element to allow the user to pull the pin 224 against its outward bias and out of one of the depressions 222, vertically move the inner cup assembly 104, and then release the pin 224 into a depression 222 at a different elevation. Hence, the inner cup assembly 104 can be easily adjusted to a desired height.

Figure 19:
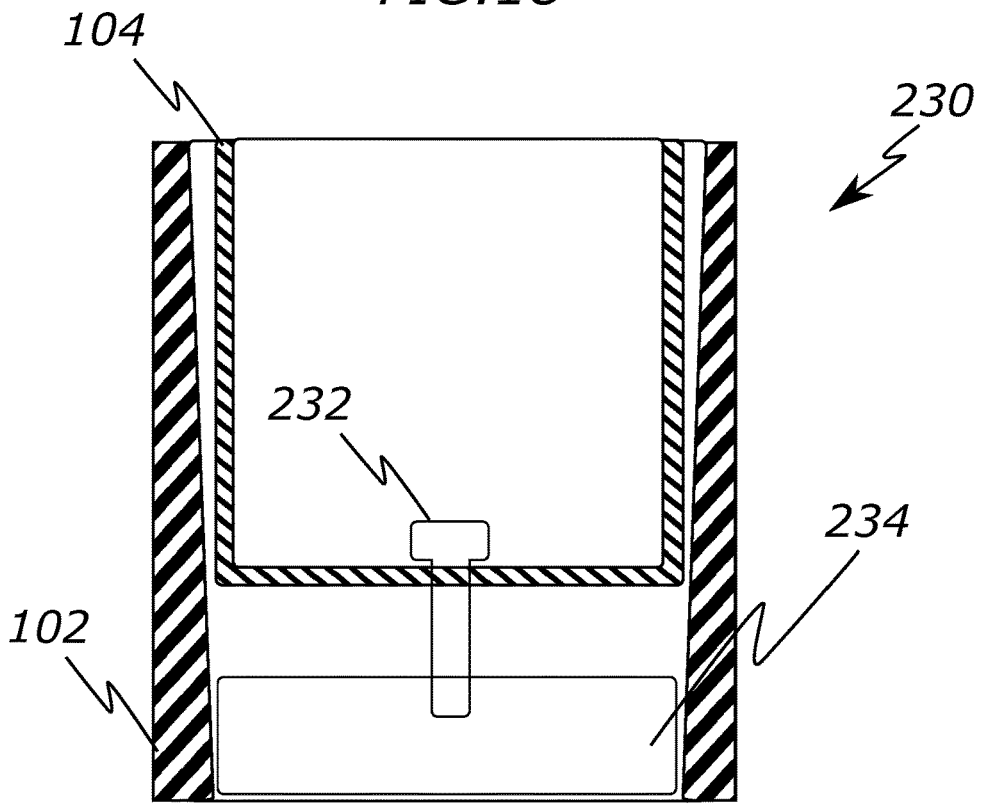
FIG. 19 illustrates another embodiment of a golf cup device with a height adjustment mechanism.

FIG. 19 illustrates another embodiment of a golf cup device 230 with a height adjustment mechanism. Specifically, the height adjustment mechanism comprises a screw 232 (or similar threaded member) that passes through the floor of the inner cup assembly 104 and threads into a lower structure 234 near the bottom of the outer sleeve 102. The screw 232 can either be engaged with the inner cup assembly 104 via a second set of threads or it can be "captured" so as to freely rotate relative to the inner cup assembly 104 but without vertical movement. As the screw 232 rotates, it moves through the mating threads of structure 234, increasing or decreasing the height of the inner cup assembly 104, depending on the rotational direction the screw 232 is screwed in.

Figure 20:
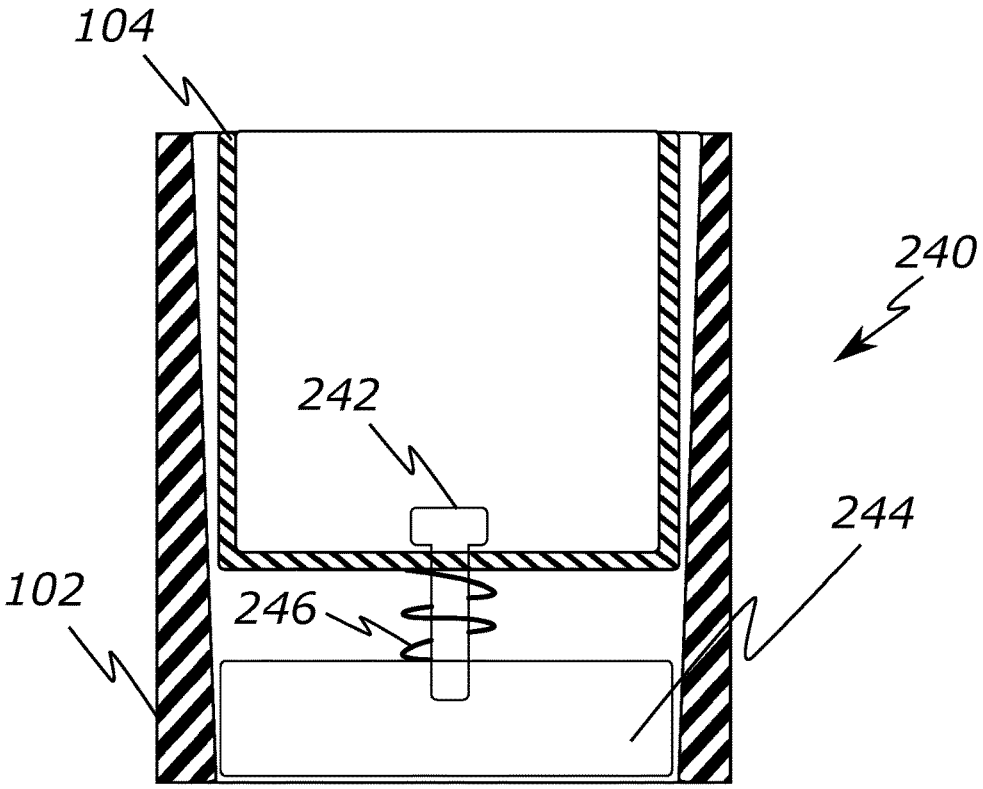
FIG. 20 illustrates another embodiment of a golf cup device with a height adjustment mechanism.

FIG. 20 illustrates a golf cup device 240 that is generally similar to the previous device 230, with a screw 242 and a structure 244 with a mating thread to the screw 242. However, instead of the screw 242 being captured or threaded to the floor of the inner cup assembly 104, a spring 246 is included between the bottom of the inner cup assembly 104 and the structure 244. This spring 246 maintains or biases the floor of the inner cup assembly 104 against the screw head of the screw 242, preventing it from falling downward on the structure 244.

Figure 21:
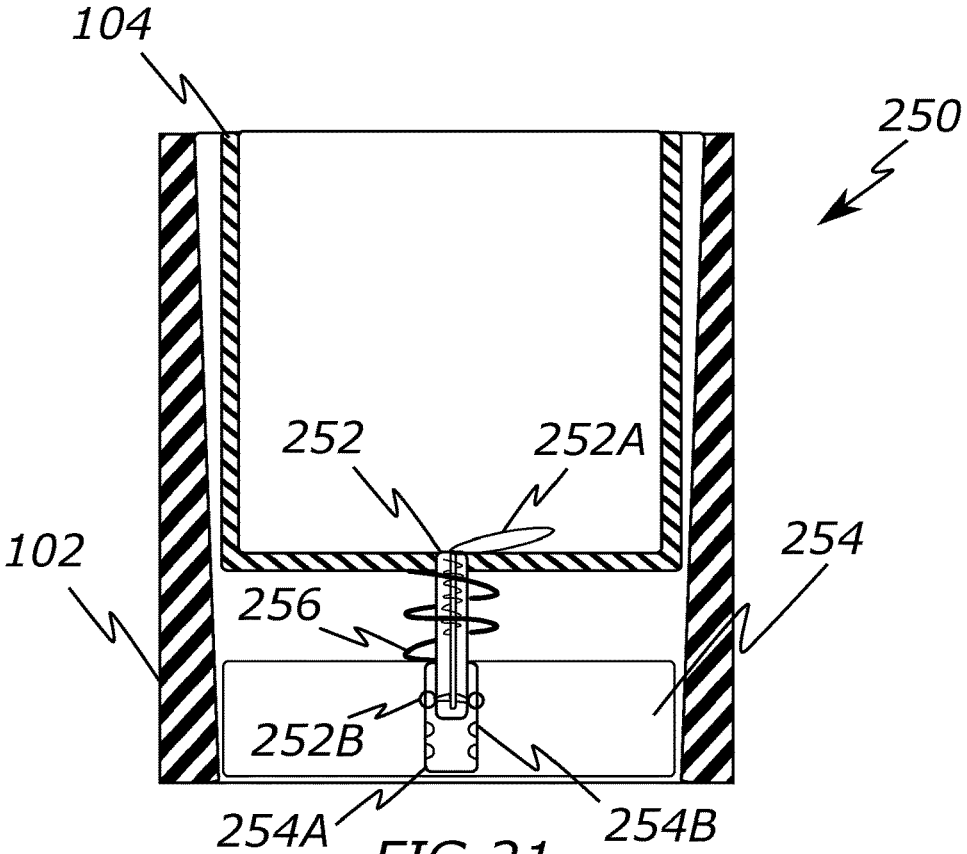
FIG. 21 illustrates another embodiment of a golf cup device with a height adjustment mechanism.

FIG. 21 illustrates another embodiment of a golf cup device 250 with a height adjustment mechanism. Specifically, the height adjustment mechanism comprises a detent mechanism that allows detents at different heights to be engaged. FIG. 21 illustrates one example of a ball and detent mechanism in which a lower structure 254 has a central cylindrical passage 254A with a plurality of detents or apertures 254 at various heights. A detent engagement mechanism 252 can be moved vertically within the passage 254A to allow one or more ball members 252B on its lower end to engage with the detents/apertures 254B.

The detent engagement mechanism 252 may include a cylindrical body containing a spring biased pin that is connected to the one or more ball members 252B to bias then radially outwards. When the user pulls a ring 252A connected to the inner pin, it pulls on and retracts the one or more ball members 252B into the body. Hence, the user can releasably lock the height of the inner cup assembly 104, which is fixed to the detent engagement mechanism 252. The detents/apertures 254B can be vertically spaced from each other by a variety of different distances, including 0.1 inch, 0.25 inch, 0.5 inch, 0.75 inch, or 1 inch. Optionally, a spring 256 may be included between the lower structure 254 and the bottom of the inner cup assembly 104 to provide additional support.

Figure 22:
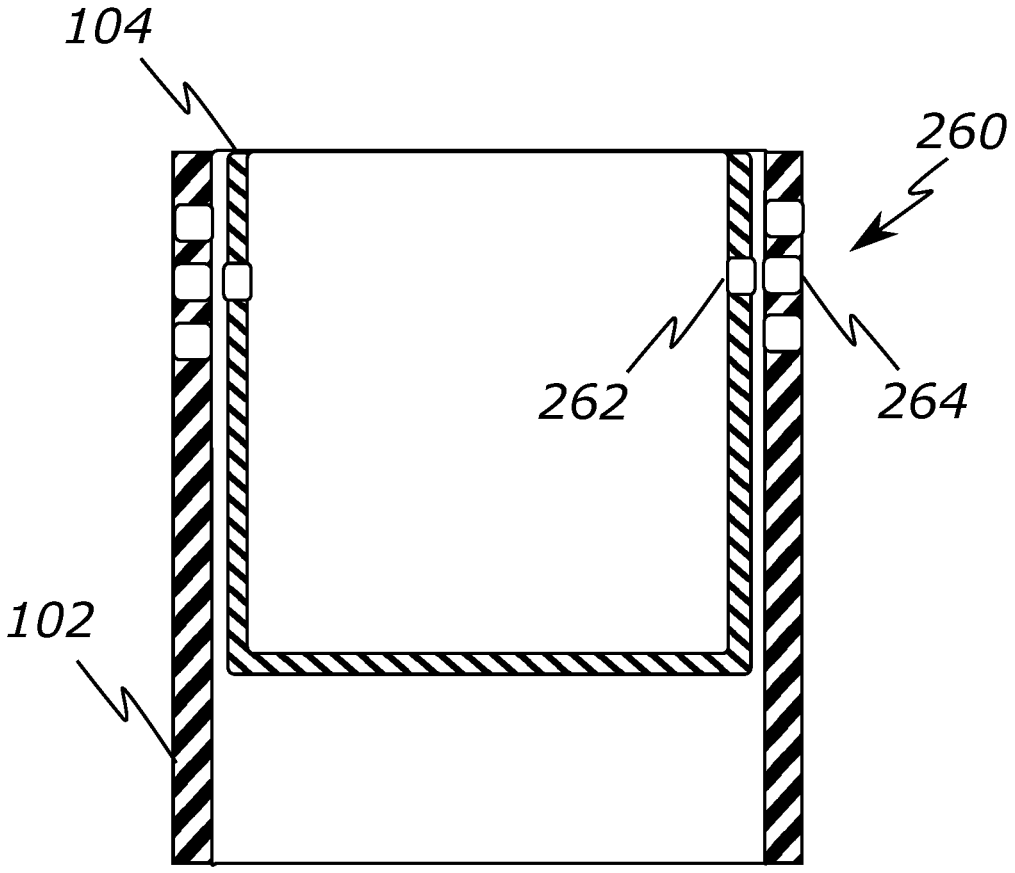
FIG. 22 illustrates another embodiment of a golf cup device with a height adjustment mechanism.

FIG. 22 illustrates another embodiment of a golf cup device 260 with a height adjustment mechanism. Specifically, the height adjustment mechanism comprises a plurality of magnets that may retain the inner cup assembly 104 at various heights. For example, the outer sleeve 102 may include a plurality of magnets 264 at various circumferential and vertical positions. The inner cup assembly 104 also includes a plurality of magnets 264 that are at least positioned along a single circumferential level. The magnets 262 of the inner cup assembly 104 are configured to attract the magnets 264 that they are horizontally aligned with. Hence, a user may push the inner cup assembly 104 to a desired vertical position in the sleeve 102 and the magnets 262, 264 will attract each other and maintain the position of the inner cup assembly 104. In one example, the magnets 264 of the sleeve 102 are positioned at repeating vertical positions from each other, including 0.1 inch, 0.25 inch, 0.5 inch, 0.75 inch, or 1 inch.

In some aspects, the techniques described herein relate to a golf cup, including: an outer sleeve having an inner wall surface; an inner cup assembly having an outer wall surface and being positioned entirely within the outer sleeve and inner wall surface; and, a height adjustment mechanism including one or more structures extending from the outer wall surface of the inner cup assembly, the inner wall surface of the outer sleeve, or both the outer wall surface of the inner cup assembly and the inner cup assembly, the inner wall surface of the outer sleeve.

In some aspects, the techniques described herein relate to a golf cup, wherein the one or more structures include a plurality of ribs extending radially inward from the inner surface of the outer sleeve; and wherein the height adjustment mechanism includes a plurality of stepped regions extending from a bottom of the inner cup assembly.

In some aspects, the techniques described herein relate to a golf cup, wherein the plurality of ribs are spaced apart so as to contact stepped regions of the plurality of stepped regions that have a same height relative to inner cup assembly.

In some aspects, the techniques described herein relate to a golf cup, wherein the plurality of ribs are vertically oriented and have a first portion that extends radially inward a first distance and a second portion that extends radially inward a second distance, wherein the second distance is less than the first distance.

In some aspects, the techniques described herein relate to a golf cup, wherein the plurality of stepped regions have a groove having a width sized to accept one of the plurality of ribs.

In some aspects, the techniques described herein relate to a golf cup, wherein the inner cup assembly includes a cup shape with an internal cup bottom portion; and wherein the inner cup assembly further include one or more lights positioned to shine through gaps within the internal cup bottom portion.

In some aspects, the techniques described herein relate to a golf cup, wherein the one or more structures include a first set screw positioned through a first aperture in a sidewall of the inner cup assembly; wherein the set screw is configured to press against the inner wall surface of the outer sleeve.

In some aspects, the techniques described herein relate to a golf cup, wherein the inner wall surface of the outer sleeve increases in radially diameter in a downward direction.

In some aspects, the techniques described herein relate to a golf cup, wherein the one or more structures include a resilient ring positioned on the outer wall surface of the inner cup assembly; wherein the resilient ring is movable upwards and downwards along the outer wall surface; and wherein the inner wall surface of the outer sleeve increases in radially diameter in a downward direction.

In some aspects, the techniques described herein relate to a golf cup, wherein the one or more structures include a first helical thread on the outer wall surface of the inner cup assembly, and a second helical thread on the inner wall surface of the outer sleeve; wherein the first thread and the second thread are configured to mate and engage with each other.

In some aspects, the techniques described herein relate to a golf cup, wherein the one or more structures include one or more pins extending from the outer wall surface of the inner cup assembly, and one or more channels in the inner wall surface of the outer sleeve that are sized to accommodate the one or more pins.

In some aspects, the techniques described herein relate to a golf cup, wherein the one or more channels include a vertical channel and two or more horizontal channels connected to the vertical channel.

In some aspects, the techniques described herein relate to a golf cup, wherein the one or more structures include a plurality of sleeve horizontal ridges extending from the inner wall surface of the outer sleeve, and at least one cup horizontal ridge; wherein the at least one cup horizontal ridge engages the plurality of sleeve horizontal ridges in a first rotational orientation of the inner cup assembly and wherein the at least one cup horizontal ridge disengages the plurality of sleeve horizontal ridges in a second rotational orientation of the inner cup assembly.

In some aspects, the techniques described herein relate to a golf cup, wherein the plurality of sleeve horizontal ridges and the at least one cup horizontal ridge are both arc shaped and horizontally oriented.

In some aspects, the techniques described herein relate to a golf cup, wherein the one or more structures include a spring-loaded pull-pin positioned through an aperture through a wall of the inner cup assembly and extends radially outward from the outer wall surface in a first position and is moved radially inward in a second, pulled position.

In some aspects, the techniques described herein relate to a golf cup, wherein the inner wall surface of the outer sleeve includes a plurality of depressions sized to accept the pull pin in the second position, wherein the plurality of depressions are located at different heights.

In some aspects, the techniques described herein relate to a golf cup, wherein the one or more structures include a plurality of magnets.

In some aspects, the techniques described herein relate to a golf cup, including: an outer sleeve including and interior passage and one or more ribs extending radially inward from its interior passage; and, an inner cup assembly including a plurality of stepped regions positioned to rest on the one or more ribs; wherein adjusting a rotational position of the inner cup assembly relative to the outer cup assembly repositions the plurality of stepped regions relative to the one or more ribs to thereby change an elevation of the inner cup assembly relative to the outer sleeve.

In some aspects, the techniques described herein relate to a golf cup, wherein the plurality of stepped regions further include a groove sized to engage the one or more ribs.

In some aspects, the techniques described herein relate to a golf cup, including: an outer sleeve including a sleeve sidewall; an inner cup assembly including a cup wall; and, one or more wall structures located between the sleeve sidewall and the cup wall; wherein the one or more wall structures releasably secure the inner cup assembly at different heights relative to the outer sleeve.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A golf cup, comprising:

an outer sleeve having an inner wall surface;

an inner cup assembly having an outer wall surface and being positioned entirely within the outer sleeve and inner wall surface; and, a height adjustment mechanism comprising one or more structures extending from the outer wall surface of the inner cup assembly, the inner wall surface of the outer sleeve, or both the outer wall surface of the inner cup assembly and the inner cup assembly, the inner wall surface of the outer sleeve;

wherein the height adjustment mechanism includes a plurality of stepped regions extending from a bottom of the inner cup assembly.

2. A golf cup, comprising:

an outer sleeve having an inner wall surface;

an inner cup assembly having an outer wall surface and being positioned entirely within the outer sleeve and inner wall surface; and, a height adjustment mechanism comprising one or more structures extending from the outer wall surface of the inner cup assembly, the inner wall surface of the outer sleeve, or both the outer wall surface of the inner cup assembly and the inner cup assembly, the inner wall surface of the outer sleeve;

wherein the one or more structures include a plurality of ribs extending radially inward from the inner surface of the outer sleeve.

3. The golf cup of claim 2, wherein the plurality of ribs support the inner cup assembly in a first rotational orientation and at a first height, and wherein the plurality of ribs support the inner cup assembly in a second rotational orientation at a second height.

4. The golf cup of claim 1, wherein the one or more structures of the height adjustment mechanism further comprises a plurality of ribs on an inner surface of the outer sleeve that are vertically oriented.

5. The golf cup of claim 4, wherein the plurality of stepped regions include a groove having a width sized to accept one of the plurality of ribs.

6. The golf cup of claim 1, wherein the inner cup assembly comprises a cup shape with an internal cup bottom portion; and wherein the inner cup assembly further comprises one or more lights positioned to shine through gaps within the internal cup bottom portion.

7. A golf cup, comprising:

an outer sleeve having an inner wall surface;

an inner cup assembly having an outer wall surface and being positioned entirely within the outer sleeve and inner wall surface; and, a height adjustment mechanism comprising one or more structures extending from the outer wall surface of the inner cup assembly, the inner wall surface of the outer sleeve, or both the outer wall surface of the inner cup assembly and the inner cup assembly, the inner wall surface of the outer sleeve;

wherein the one or more structures comprise a first set screw positioned through a first aperture in a sidewall of the inner cup assembly; wherein the set screw is configured to press against the inner wall surface of the outer sleeve.

8. The golf cup of claim 7, wherein the inner wall surface of the outer sleeve increases in diameter in a downward direction.

9. A golf cup, comprising:

an outer sleeve having an inner wall surface;

an inner cup assembly having an outer wall surface and being positioned entirely within the outer sleeve and inner wall surface; and, a height adjustment mechanism comprising one or more structures extending from the outer wall surface of the inner cup assembly, the inner wall surface of the outer sleeve, or both the outer wall surface of the inner cup assembly and the inner cup assembly, the inner wall surface of the outer sleeve;

wherein the one or more structures comprise a resilient ring positioned on the outer wall surface of the inner cup assembly; wherein the resilient ring is movable upwards and downwards along the outer wall surface; and wherein the inner wall surface of the outer sleeve decreases in diameter along a downward direction.

10. A golf cup, comprising:

an outer sleeve having an inner wall surface;

an inner cup assembly having an outer wall surface and being positioned entirely within the outer sleeve and inner wall surface; and, a height adjustment mechanism comprising one or more structures extending from the outer wall surface of the inner cup assembly, the inner wall surface of the outer sleeve, or both the outer wall surface of the inner cup assembly and the inner cup assembly, the inner wall surface of the outer sleeve;

wherein the one or more structures comprise a first helical thread on the outer wall surface of the inner cup assembly, and a second helical thread on the inner wall surface of the outer sleeve; wherein the first thread and the second thread are configured to mate and engage with each other.

11. A golf cup, comprising:

an outer sleeve having an inner wall surface;

an inner cup assembly having an outer wall surface and being positioned entirely within the outer sleeve and inner wall surface; and, a height adjustment mechanism comprising one or more structures extending from the outer wall surface of the inner cup assembly, the inner wall surface of the outer sleeve, or both the outer wall surface of the inner cup assembly and the inner cup assembly, the inner wall surface of the outer sleeve;

wherein the one or more structures comprise a plurality of sleeve horizontal ridges extending from the inner wall surface of the outer sleeve, and at least one cup horizontal ridge; wherein the at least one cup horizontal ridge engages the plurality of sleeve horizontal ridges in a first rotational orientation of the inner cup assembly and wherein the at least one cup horizontal ridge disengages the plurality of sleeve horizontal ridges in a second rotational orientation of the inner cup assembly.

12. The golf cup of claim 11, wherein the plurality of sleeve horizontal ridges and the at least one cup horizontal ridge are both arc shaped and horizontally oriented.

13. A golf cup, comprising:

an outer sleeve having an inner wall surface;

an inner cup assembly having an outer wall surface and being positioned entirely within the outer sleeve and inner wall surface; and, a height adjustment mechanism comprising one or more structures extending from the outer wall surface of the inner cup assembly, the inner wall surface of the outer sleeve, or both the outer wall surface of the inner cup assembly and the inner cup assembly, the inner wall surface of the outer sleeve;

wherein the one or more structures comprise a spring-loaded pull-pin positioned through an aperture through a wall of the inner cup assembly and extends radially outward from the outer wall surface in a first position and is moved radially inward in a second, pulled position.

14. The golf cup of claim 13, wherein the inner wall surface of the outer sleeve includes a plurality of depressions sized to accept the pull pin pull-pin in the second position, wherein the plurality of depressions are located at different heights.

15. A golf cup, comprising:

an outer sleeve having an inner wall surface;

an inner cup assembly having an outer wall surface and being positioned entirely within the outer sleeve and inner wall surface; and, a height adjustment mechanism comprising one or more structures extending from the outer wall surface of the inner cup assembly, the inner wall surface of the outer sleeve, or both the outer wall surface of the inner cup assembly and the inner cup assembly, the inner wall surface of the outer sleeve;

wherein the one or more structures comprise a plurality of magnets.

16. A golf cup, comprising:

an outer sleeve comprising and interior passage and one or more ribs extending radially inward from its interior passage; and, an inner cup assembly comprising a plurality of stepped regions positioned to rest on the one or more ribs;

wherein adjusting a rotational position of the inner cup assembly relative to the outer cup assembly repositions the plurality of stepped regions relative to the one or more ribs to thereby change an elevation of the inner cup assembly relative to the outer sleeve.

17. The golf cup of claim 16, wherein the plurality of stepped regions further include a groove sized to engage the one or more ribs.

18. A golf cup, comprising:

an outer sleeve comprising a sleeve sidewall;

an inner cup assembly comprising a cup wall; and, one or more wall structures located between the sleeve sidewall and the cup wall;

wherein the one or more wall structures releasably secure the inner cup assembly at different heights relative to the outer sleeve;

wherein the one or more wall structures include a plurality of steps or raised surfaces located at different vertical positions between the inner cup assembly and the outer sleeve.

19. The golf cup of claim 18, wherein the plurality of steps or raised surfaces are connected to a bottom of the inner cup assembly.

20. The golf cup of claim 18, wherein the plurality of steps or raised surfaces are connected to an inside surface of the outer sleeve.

* * * * *